US006530978B2

(12) United States Patent
McQuigg et al.

(10) Patent No.: US 6,530,978 B2
(45) Date of Patent: Mar. 11, 2003

(54) SYSTEM FOR REMOVING PARTICULATE AND AEROSOL FROM A GAS STREAM

(75) Inventors: Kevin McQuigg, Broken Arrow, OK (US); William Norman Scott, Tulsa, OK (US)

(73) Assignee: Energy Process Technologies, Inc, Tulsa, OK (US)

( * ) Notice: Subject to any disclaimer, the term of this patent is extended or adjusted under 35 U.S.C. 154(b) by 0 days.

(21) Appl. No.: 09/910,231

(22) Filed: Jul. 20, 2001

(65) Prior Publication Data

US 2001/0045162 A1 Nov. 29, 2001

Related U.S. Application Data

(63) Continuation-in-part of application No. 09/443,975, filed on Nov. 19, 1999, now Pat. No. 6,312,505.

(51) Int. Cl.[7] ..... B01D 45/14; B01D 47/06; B01D 50/00; B01D 53/75

(52) U.S. Cl. ..... 95/218; 95/219; 95/228; 95/229; 55/315.2; 55/438; 96/188; 96/355; 96/359; 96/366

(58) Field of Search ..... 95/218, 219, 228, 95/229, 198, 221; 55/315.1, 315.2, 315, 438, 459.1; 96/188, 316, 355, 359, 360, 306, 311, 366

(56) References Cited

U.S. PATENT DOCUMENTS

| | | | | |
|---|---|---|---|---|
| 460,152 A | | 9/1891 | Morse | |
| 2,822,062 A | | 2/1958 | Haberl et al. | |
| 3,639,261 A | | 2/1972 | Slater | |
| 3,866,411 A | | 2/1975 | Marion et al. | |
| 4,149,859 A | * | 4/1979 | Vigesdal | 252/373 |
| 4,279,627 A | | 7/1981 | Paul et al. | |
| 4,451,270 A | | 5/1984 | Roman | |
| 5,391,220 A | | 2/1995 | Patterson | |

FOREIGN PATENT DOCUMENTS

| | | |
|---|---|---|
| DE | 109658 | 11/1974 |
| DE | 1520041 | 8/1978 |
| DE | 19529536 A1 | 2/1997 |

* cited by examiner

*Primary Examiner*—Robert A. Hopkins
(74) *Attorney, Agent, or Firm*—Molly D. McKay

(57) ABSTRACT

The present invention is a system 100 for removing particulate matter and aerosols from a gas stream generated by gasification prior to the gas stream being used as fuel in an internal combustion device or as synthesis gas for subsequent processing. The present invention consists of removing excess ash by passing the gas stream through a high temperature cyclone separator 102, cooling the gas stream, oil scrubbing the gas to further cool it and to remove particulates and some tars, passing the gas stream through one or more vortex chambers 28 to remove additional tars, passing the gas stream through a heat exchanger 104 to cool the gas, and finally passing the gas stream through a demister 106 to remove aerosols from the gas.

10 Claims, 5 Drawing Sheets

SYSTEM FOR REMOVING PARTICULATE AND AEROSOL FROM A GAS STREAM

CROSS-REFERENCE TO RELATED APPLICATIONS

This application is a continuation in part of U.S. patent application Ser. No. 09/443,975 for Method for Removing Particulate and Aerosol From a Gas Stream filed on Nov. 19, 1999 now U.S. Pat. No. 6,312,505.

BACKGROUND OF THE INVENTION

1. Field of the Invention

The present invention relates to an improvement in a process for removing particulate and aerosol droplets from a stream of gases. More specifically, the present invention relates to a more effective system for removing entrained particles and droplets of tar from a gas stream originating from a source such as a biomass gasifier so that the resulting cleaned gas stream is suitable fuel for operating an internal combustion device, such as an engine or turbine, which may be coupled to an electrical generator or can be utilized as a synthetic gas for subsequent processing. For the purposes of simplicity, an internal combustion device is discussed herein.

2. Description of the Related Art

Developing countries need decentralized sources of power, i.e. power systems for each remote community. In developing countries, where natural gas, petroleum products, or coal are not readily available to remote communities and hydropower is not possible, communities often have some local form of biomass that could serve as an energy source if that biomass could be converted to electrical power. Locally available forms of biomass might include rice straw or rice hulls, sugar cane bagasse, poultry litter, refuse, paper plant pulp sludge, switchgrass, waste resulting from extraction of olive oil from olives, peanut shells, sawdust or wood chips, wood bark, municipal solid waste, coconut shells, corn cobs, cotton stover, etc.

Industrialized nations have a heightened awareness of the environmentally deleterious effects of the production of "greenhouse gases" including carbon dioxide produced by the combustion of fossil fuels. Many nations have agreed to aggressively reduce their production of these "greenhouse gases" by encouraging the use of alternate, renewable energy such as biomass. A concurrence of nations was reached during the summit conference on the environment that was held in Kyoto, Japan several years ago.

Technology is currently available for converting biomass materials, by heating the biomass materials under starved oxygen conditions, to a gas stream that has sufficient heating value to operate an internal combustion device, i.e. in the range of 125 to 250 BTUs per standard cubic foot, depending on the biomass materials being processed. The resulting gas stream contains nitrogen, carbon dioxide, trace amounts of carry-over ash and tar, and calorific constituents of carbon monoxide, hydrogen, and some alkanes and alkenes. Gasification is recognized worldwide as an innovative method of converting biomass into energy.

However, one of the problems that has been experienced with converting biomass to energy is that the gas stream that is produced by gasification units is contaminated with particulate matter and with aerosol droplets of tar that can foul an internal combustion device unless they are efficiently removed from the gas stream prior to introducing the gas stream into the device. Currently there is not an economical method for effectively removing the entrained particulate matter and the aerosol droplets of tar from these types of gas streams. The reason that the particulate matter and aerosol droplets of tar can not be easily be removed from the gas stream is that a large portion of the particles and droplets are micron to sub-micron in size and are not effectively removed by traditional gas scrubbing processes.

The invention addresses this problem by first passing the gas that is generated by the gasifier through a high temperature cyclone separator to remove most of the carry over ash from the gasifier to prevent fouling of the downstream equipment. Then the gas that exits the cyclone separator is passed through an indirect gas cooler, a direct contact spray scrubber chamber, then followed by one or more enhanced vortex chambers. To achieve the desired cleanliness in the resulting gas stream, it may be necessary to employ two or more vortex chambers in series. When the gas exits the vortex chambers, it passes through an inducted draft fan, then finally through a heat exchanger where the gas is cooled to condense additional impurities and then a demister or mist eliminator where those impurities are extracted from the gas.

The high temperature cyclone separator operates at approximately 1,000 degrees Fahrenheit, thus removing the entrained fly ash without cooling appreciably. The cyclone separator is a conventional type of cyclone separator designed for high temperature operation. The cyclone separator removes approximately 90% of the ash that is carried over in the gas from the gasifier. Removal of this ash prevents fouling of the downstream equipment, particularly the indirect gas cooler located immediately downstream of the cyclone separator. Also, removal of the ash reduces the loading on the direct contact spray scrubber located downstream of the indirect gas cooler. Thus, the addition of a high temperature cyclone separator between the gasifier and the indirect gas cooler allows the system to operate for longer periods of time without being brought down for cleaning and allows the system to do a better job of cleaning the gas.

The indirect gas cooler is a shell and tube heat exchanger that cools the gas stream from the gasifier by indirect heat exchange with a cooling medium such as air or water. The direct contact spray scrubber employs a liquid hydrocarbon, such as used motor oil, to scrub out the particulate matter and some of the organic aerosols that are entrained in the gas stream as the gas stream passes through the direct contact spray scrubber.

Once the gas exits the direct contact spray scrubber, it enters the enhanced vortex or vortices. Each enhanced vortex chamber employs a high-speed fan to propel the remaining entrained droplets of tar against the inside surface of the vortex chamber along with additional oil. When the droplets of tar hit the oil coated inside surface of each vortex chamber, the droplets coalesce on the surface. The tar and oil mixture then gravity flows out of each vortex chamber, thereby removing the tar from the gas stream. The gas stream, having thus been cleaned of its particulate and aerosol impurities, then enters a low-pressure surge tank. If the gasifier is operating at a pressure less than atmospheric pressure, an induced draft fan may be employed to convey the gas through the system.

When the gas exits the vortex chambers, it passes through a heat exchanger that cools the gas to less than 120 degrees Fahrenheit, thus condensing additional impurities and water. Finally, the gas passes through a demister where the condensed impurities and water are extracted from the gas.

From here, the gas stream can be sent directly to the internal combustion device for mixing with combustion air so that it can be burned in such internal combustion device, such as an engine or turbine, which may be coupled to an electrical generator or can be utilized as a synthetic gas for subsequent processing.

SUMMARY OF THE INVENTION

The present invention is an improvement in a method for removing particulate matter and aerosols from a gas stream generated by a biomass gasification unit. The invention consists of first removing the excess ash by passing the gas through a high temperature cyclone separator, then cooling the gas stream, oil scrubbing it to remove particulate matter and some tars and to further reduce the temperature of the gas stream, passing the gas stream through one or more vortex chambers to remove additional tars, and finally cooling the gas to condense out more impurities and water and removing the condensate with a demister.

The high temperature cyclone separator operates at approximately 1,000 degrees Fahrenheit, thus removing the entrained fly ash without cooling the gas appreciably. The cyclone separator is a conventional cyclone separator designed for high temperature operation. The cyclone separator removes approximately 90% of the ash that is carried over in the gas from the gasifier. Removal of this ash prevents fouling of the indirect gas cooler located immediately downstream of the cyclone separator, and reduces the particulate loading on the direct contact spray scrubber located downstream of the indirect gas cooler. Thus, the removal of the majority of the ash by the cyclone separator allows the system to operate for longer periods of time without being brought down for cleaning.

Once the gas stream exits the cyclone separator, it passes through an indirect gas cooler to reduce the temperature of the gas stream to a temperature that will not crack petroleum scrubbing liquor, i.e. a temperature below approximately 600 degrees Fahrenheit. If the gas stream is cooled below 450 degrees Fahrenheit, tars may condense in the indirect gas cooler, thereby restricting gas flow. Therefore, the most desirable temperature range is between 450 and 600 degrees Fahrenheit. Cooling of the gas stream is necessary since the gas exits the gasification unit at a high temperature, i.e. approximately 1200–1500 degrees Fahrenheit. The gas stream must be cooled to a temperature that will not crack petroleum products, such as the motor oil, since the gas stream will come in contact with the petroleum scrubbing liquor when it enters the next vessel in the process, i.e. a direct contact spray scrubber. The indirect gas cooler employs indirect heat exchange with air or water to cool the gas stream to an acceptable temperature. To minimize gas flow restriction from impurity accumulation, the minimum heat exchanger tubing size should not be less than 2 inch.

Upon leaving the indirect gas cooler, the gas stream enters a direct contact spray scrubber. The direct contact spray scrubber employs a liquid hydrocarbon, such as used motor oil, to directly scrub and cool the gas stream and remove the particulate matter, some of the organic aerosols, and some water that is entrained in the gas stream. Within the direct contact spray scrubber, a petroleum product or oil, such as used motor oil, is sprayed into the gas stream countercurrent to the direction of flow of the gas stream to scrub out particulate matter and some of the tar droplets contained in the gas stream. Some of the excess water also is removed by condensation in the direct contact spray scrubber since the temperature of the gas stream falls below the water vapor dew point within the direct contact spray scrubber. This water condensation occurs around sub-micron particle seed that promotes particle growth. The enlarged particles are more effectively removed in the downstream, enhanced vortex chamber or chambers. The gas stream exits the direct contact spray scrubber at a temperature of approximately 100 to 150 degrees Fahrenheit.

Upon exiting the direct contact spray scrubber, the gas stream enters an enhanced vortex chamber or chambers, if more than one vortex chamber is employed. Here the gas stream is mechanically scrubbed of tar. Additional motor oil is sprayed into the gas stream as the gas stream enters each vortex chamber. The oil and gas stream mixture enter each vortex chamber adjacent to or beneath a high-speed fan that propels the gas stream, oil, and entrained droplets of tar against the inside surface of the vortex chamber. It is believed that the vortex created by the rapidly rotating fan forms a low-pressure zone. Within this low-pressure zone, tars with a partial vapor pressure in excess of the zone pressure condense. It is further believed that the maximum fan tip speed for the high-speed fan is approximately 300 M.P.H. since fan tip speeds in excess of this speed may result in metal fatigue of the fan blades.

When the droplets of tar contact the inside surface of the vortex chamber, they adhere to the oil-coated surface and coalesce with the oil on the surface. The oil also impinges on the fan blades and serves to keep the blades cleaned of tar that might otherwise accumulate. The temperature of the gas stream is approximately 100 to 150 degrees Fahrenheit when it initially enters the first vortex chamber and is approximately 125 degrees Fahrenheit when it exits the last vortex chamber. The increase in temperature of the gas stream as it passes through the vortex chamber or chambers is due to the heat of compression.

Because the temperature of the interior of each vortex chamber is above the pour point temperature, the tar will flow down the wall of each vortex chamber into a sump and can be disposed of via a tar pump that connects to the sump of each vortex chamber.

When the gas exits the vortex chambers, it passes through a heat exchanger that cools the gas to less than 120 degrees Fahrenheit, thus condensing additional impurities and water. The heat exchanger may employ water or other suitable coolant as a cooling medium. Upon exiting the heat exchanger, the gas finally passes through a demister where the condensed impurities and water are extracted from the gas.

Upon leaving the demister, the gas stream is sufficiently free of particulate matter and tar that it can be burned in an internal combustion device without fouling or can be subsequently processed. Any residual particulate matter or hydrocarbon aerosols contained in the gas stream at this point are sub-micron in size and are not sufficient to cause any deterioration in extended operation of down-stream equipment.

Prior to introduction of the cleaned gas stream into down-stream equipment, the gas stream will enter a low-pressure surge tank. If the gasifier is operating at less than atmospheric pressure, an induced draft fan conveys the gas through the system and into the surge tank. The induced draft fan is located upstream of the heat exchanger and demister. The surge tank is sized in residence time to provide gas mixing, compensating for fluctuations in the gasification process. Also the surge tank serves as a final knock out drum for removal of any remaining liquids from the gas stream. The temperature of the gas stream as it enters the surge tank is less than 120 degrees Fahrenheit. From the surge tank, the gas stream flows to an internal combustion device or to subsequent processing.

DETAILED DESCRIPTION OF THE PREFERRED EMBODIMENT

The Invention of U.S. patent application Ser. No. 09/443,975

FIGS. 1–4 illustrate the invention of previous U.S. patent application Ser. No. 09/443,975. That invention is described in detail below.

Figure 1:
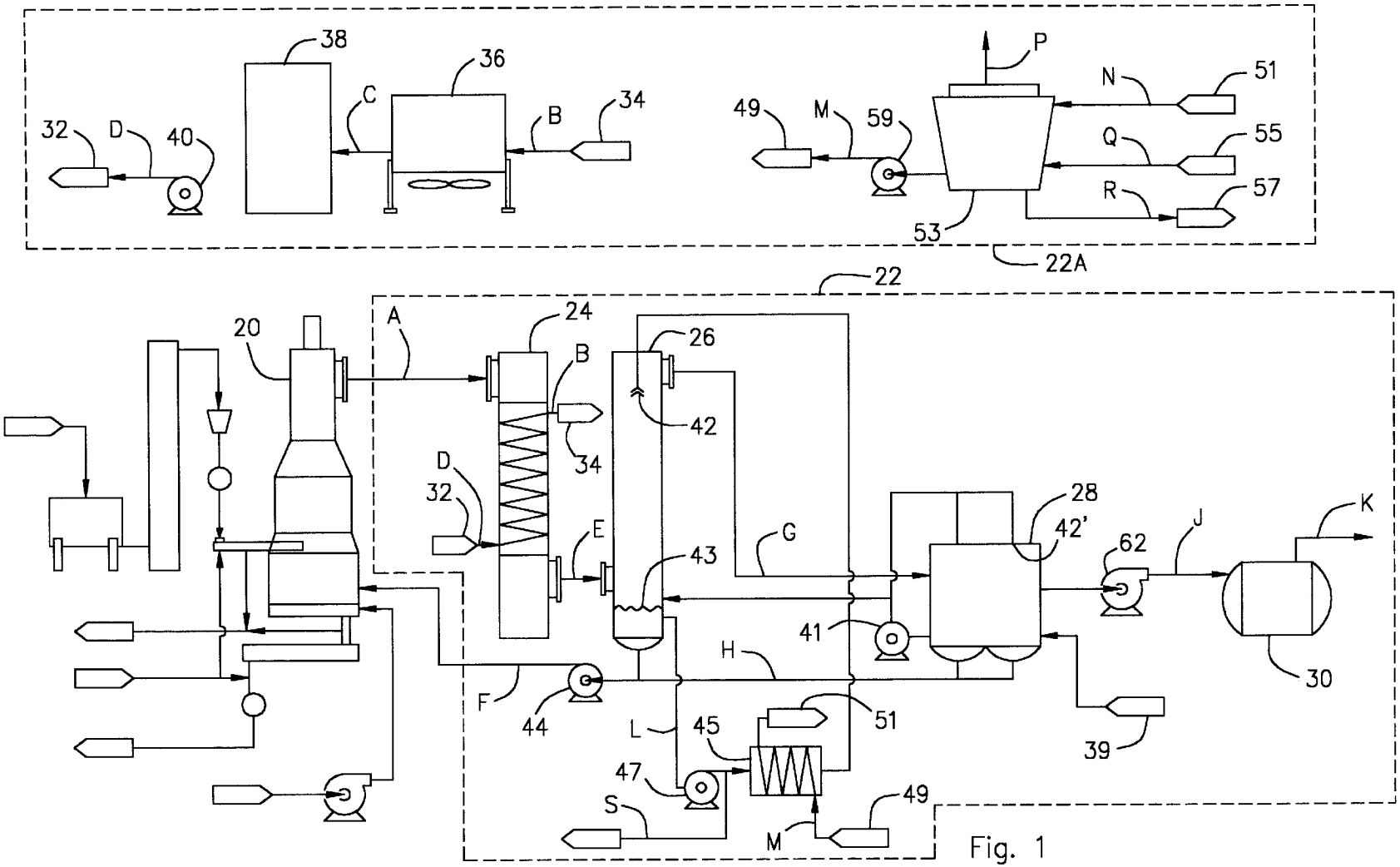
FIG. 1 is a flow diagram showing a gasifier employing equipment downstream of the gasifier that cleans the gas stream.
Figure 2:
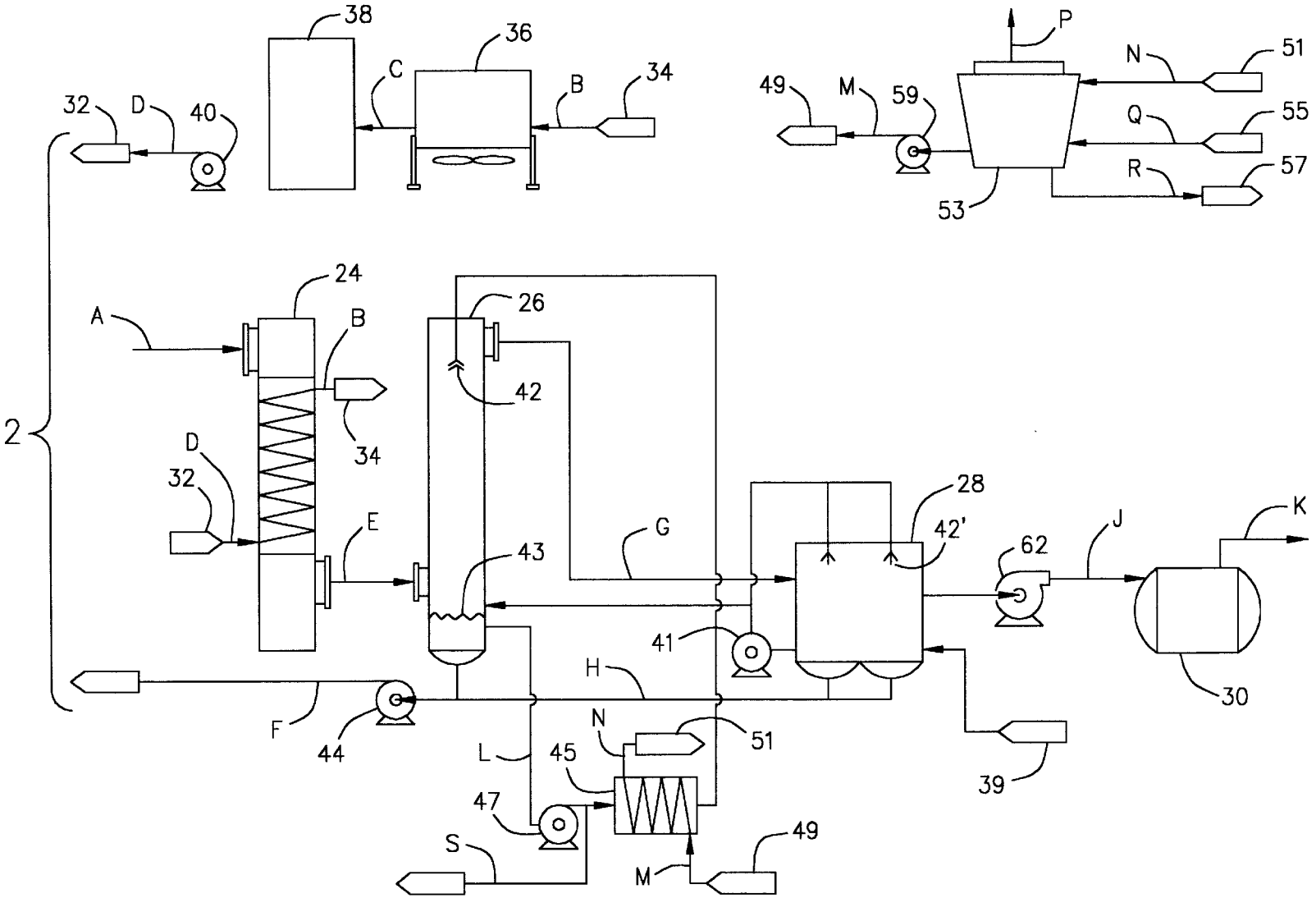
FIG. 2 is an enlarged portion of the diagram from FIG. 1, showing the equipment employed to clean the gas stream.

Referring now to the drawings and initially to FIG. 1, there is illustrated a gasifier 20 that employs a method for cleaning a gas stream generated by the gasifier 20. Box 22 and box 22A illustrate the process of the invention in FIG. 1. Box 22A shows the auxiliary cooling equipment for the process that is illustrated in box 22 and is also a part of the invention. FIG. 2 shows an enlargement of the contents of boxes 22 and 22A from FIG. 1.

The invention is a method for removing particulate matter and aerosols from a gas stream generated by a gasifier 20. As shown in box 22, the invention consists of first cooling the gas stream in an indirect gas cooler 24, then oil scrubbing the gas stream in a direct contact spray scrubber 26 to remove particulate matter, some tars and heat from the gas stream, and the finally passing the gas stream through one or more vortex chambers 28 that are provided in series to remove additional tars before the gas stream passes to a low pressure surge tank 30. For clarity, hereafter the vortex chambers 28 will be described in the singular tense, with the understanding that the singular tense also includes the plural tense since more than one vortex chamber 28 may be used in series in the invention.

As indicated by line A, the gas stream flows from the gasifier 20 to the indirect gas cooler 24. The indirect gas cooler 24 is an indirect heat exchanger and the gas stream is cooled as it passes through the indirect gas cooler 24. The most desirable temperature range for the gas stream as it exits the indirect gas cooler 24 is between 450 and 600 degrees Fahrenheit. Cooling of the gas stream is necessary since the gas exits the gasifier 20 at a high temperature, i.e. approximately 1200–1500 degrees Fahrenheit. The gas stream must be cooled to a temperature, i.e. generally below 600 degrees Fahrenheit, that will not crack petroleum scrubbing liquor, such as motor oil, since the gas stream will encounter petroleum scrubbing liquor when it enters the next vessel in the process, i.e. a direct contact spray scrubber 26. However, the gas should not be cooled below approximately 450 degrees Fahrenheit as tars may condense in the indirect gas cooler, thereby restricting flow. Although the indirect gas cooler 24 is hereafter described as employing water as the cooling medium, air may alternately be employed as the cooling medium.

To minimize gas flow restriction from impurity accumulation, the minimum heat exchanger tubing size should not be less that 2 inch.

Still referring to FIGS. 1 and 2, numeral 32 indicates lower temperature cooling water entering the indirect gas cooler 24 and numeral 34 indicates higher temperature cooling water leaving the indirect gas cooler 24. As illustrated by line B in the upper left corner of FIG. 1, after exiting the indirect gas cooler 24, the higher temperature cooling water 34 flows to an air cooled heat exchanger 36 where the water 34 is cooled to form the lower temperature cooling water 32. This lower temperature cooling water 32 then flows, as illustrated by line C, into a cooling water surge tank 38 where it remains until a cooling water pump 40 again pumps it to the indirect gas cooler 24, as illustrated by line D.

As shown by line E, upon leaving the indirect gas cooler 24, the gas stream enters a direct contact spray scrubber 26. The direct contact spray scrubber 26 employs a liquid hydrocarbon 42, such as used motor oil or other suitable oil, to directly scrub the gas stream and remove from the gas stream the particulate matter, some of the organic aerosols or tars, and some water that is entrained in the gas stream.

Within the direct contact spray scrubber 26, the liquid hydrocarbon 42 is sprayed into the gas stream, preferably countercurrent to the direction of flow of the gas stream as illustrated in the drawings, to scrub out particulate matter and some of the tar droplets contained in the gas stream. Some excess water also is removed from the gas stream in the direct contact spray scrubber 26 since the temperature of the gas stream falls below the water vapor dew point within the direct contact spray scrubber 26, thereby allowing some of the water to condense and drop out of the gas stream. This water condensation occurs around sub-micron particle seeds which promotes particle growth. The enlarged particles are more effectively removed in the down-stream enhanced vortex chamber.

Still referring to FIGS. 1 and 2, numeral 42 indicates lower temperature liquid hydrocarbon scrubbing liquor entering the direct contact spray scrubber 26 and numeral 43 indicates higher temperature liquid hydrocarbon scrubbing liquor leaving the direct contact spray scrubber 26. As illustrated by line L, after exiting the direct contact spray scrubber 26, oil recirculating pump 47 pumps the higher temperature liquid hydrocarbon scrubbing liquor 43 to the recirculating oil cooler 45. Also as illustrated by line S, it may be necessary to periodically blow down some of the higher temperature liquid hydrocarbon scrubbing liquor 43 and condensed water as liquid blow down to maintain the quality of the scrubbing liquor.

As indicated by line M, cooling water 49 enters the recirculating oil cooler 45 where it picks up heat from the high temperature liquid hydrocarbon through indirect heat transfer and then exits the recirculating oil cooler 45 as hot cooling water 51. As shown in the upper right hand comer of FIGS. 1 and 2 by line N, the hot cooling water 51 exits the recirculating oil cooler 45 and flows to a cooling tower 53 where excess heat is lost to the atmosphere, as shown by line P, thereby converting the hot cooling water 52 back to the cooling water 49 suitable for recirculation to the recirculating oil cooler 45. Line Q illustrates that makeup water 55 is added to the cooling tower as needed to maintain the necessary volume in the cooling tower and line R illustrates that blow down 57 is removed from the cooling tower as needed to maintain proper water chemistry. Line M shows that the cooling water 49 is pumped back to the recirculating cooler 45 by employing a water recirculating pump 59.

Spent liquid hydrocarbon scrubbing liquor 43, with included tar and particulate matter that has been removed from the gas stream in the direct contact spray scrubber 26, is pumped by a tar blow down pump 44 back to the gasifier 20 as tar and ash blow down that becomes a part of the feedstock to the gasifier 20, as illustrated by line F. The gas stream exits the direct contact spray scrubber 26 at a temperature of approximately 150 degrees Fahrenheit or less.

As indicated by line G, upon exiting the direct contact spray scrubber 26, the gas stream enters the enhanced vortex chamber 28. Here the gas stream is mechanically scrubbed of almost all of the remaining entrained tar and any residual particulate matter. A small amount of additional liquid hydrocarbon 42', such as for example motor oil, is sprayed into the gas stream as the gas stream enters the vortex chamber 28.

As shown, the additional liquid hydrocarbon 42' is recirculated through the vortex chamber 28 via oil recirculating pump 41 and fresh oil 39 is added to the vortex chamber 28 as make up for the liquid hydrocarbon 42'.

Figure 4:
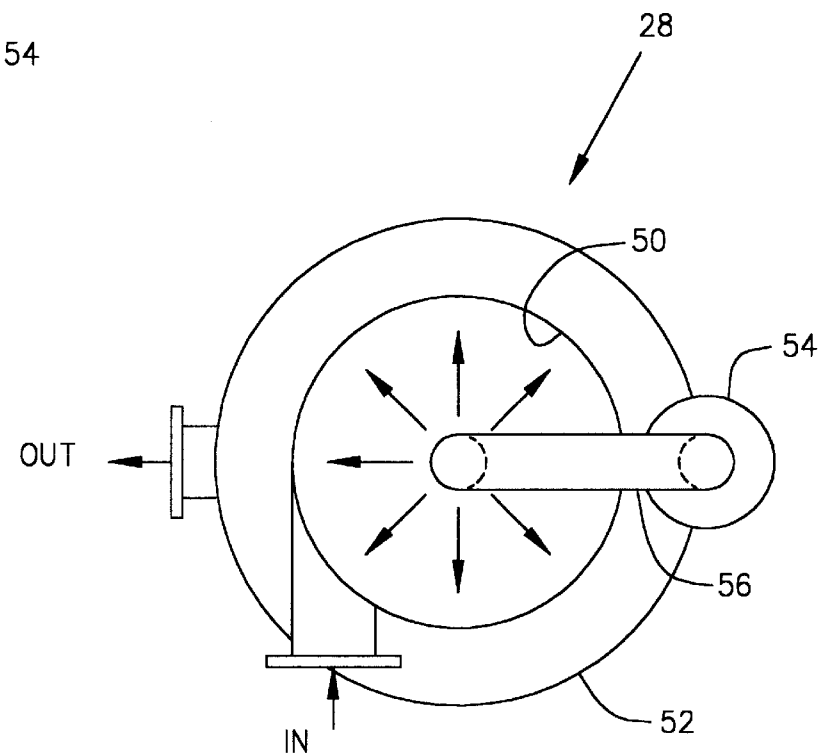
FIG. 4 is a top plan view of the vortex chamber shown in FIG. 3.
Figure 3:
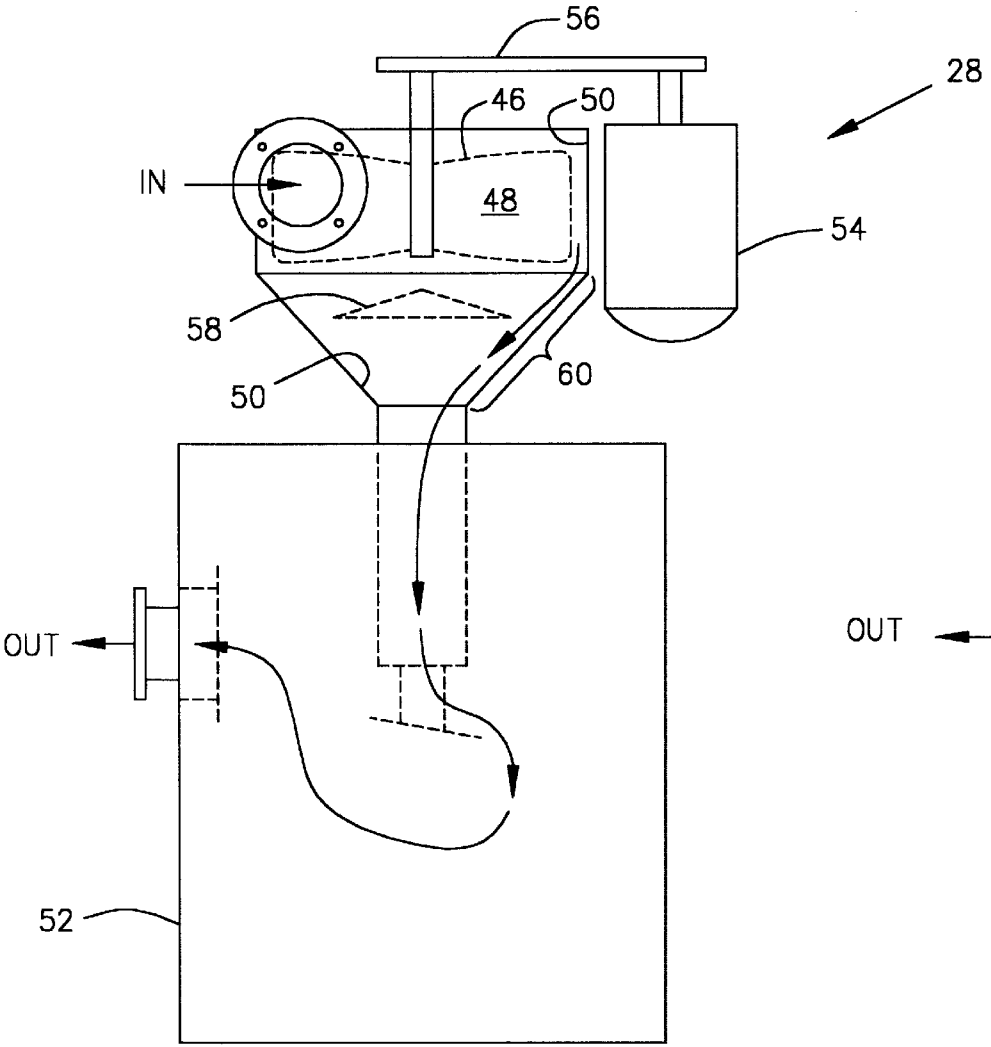
FIG. 3 is a side view of a vortex chamber employed in FIGS. 1 and 2.

Referring now also to FIGS. 3 and 4, the oil and gas stream mixture enters the vortex chamber 28 adjacent to or beneath a high-speed fan 46. The fan 46 has rotating fan blades 48 that propels the gas stream, oil, and entrained droplets of tar against the inside surface 50 of the vortex chamber 28. It is believed that the vortex created by the rapidly rotating fan forms a low-pressure zone. Within this low-pressure zone, tars with a partial vapor pressure in excess of the zone pressure condense. It is further believed that the maximum fan tip speed for the high-speed fan 46 is approximately 300 M.P.H. since fan tip speeds in excess of this speed may result in metal fatigue and cause failure of the fan blades 48.

When the droplets of tar contact the inside surface 50 of the vortex chamber 28, they adhere to the liquid hydrocarbon 42' coating the inside surface 50 and the droplets coalesce. The liquid hydrocarbon 42' also impinges on the fan blades 48 and serves to keep the blades 48 cleaned of tar that might otherwise accumulate. The temperature of the gas stream is approximately 100 degrees Fahrenheit when it enters the vortex chamber 28 and is approximately 125 degrees Fahrenheit when it exits the vortex chamber 28. The increase in temperature of the gas stream as it passes through the vortex chamber 28 is due to the heat of compression.

Because the temperature of the interior of the vortex chamber 28 is above the pour point temperature of the tar, the tar flows down the walls of the vortex chamber 28 with the liquid hydrocarbon 42' into a bottom or sump 52 of the vortex chamber 28. The mixture is disposed of via the tar blow down pump 44 that connects to the sump 52 of the vortex chamber 28 and pumps the tar and spent liquid hydrocarbon 42' to the gasifier 20, as shown by line H and by previously described line F. The flow of the gas stream through the vortex chamber 28 is illustrated in FIGS. 3 and 4 by the arrows.

Referring now to FIG. 3, the internal structure of the vortex chamber 28 is illustrated. The gas stream enters the vortex chamber 28 adjacent or below the blades 48 of the high-speed fan 46. A fan motor 54 that connects to the fan 46 via a fan belt 56 powers the fan 46. The fan blades 48 are oriented so that they force the gas stream outward against the inside surface 50 of the vortex chamber 28.

An inverted cone shape deflector 58 is provided within the vortex chamber 28 immediately below the fan 48. The inverted cone shaped deflector 58 lies within a cone shaped portion 60 of the vortex chamber 28 that is located below the fan 46. There is a space between the edges of the deflector 58 and the inside surface 50 of the cone shaped portion 60 of the vortex chamber 28. The clean gas stream passes through the space and into the bottom 61 of the vortex chamber 28 before exiting the vortex chamber 28. The deflector 58 directs the mixture of tar and liquid hydrocarbon 42' that falls on the deflector 58 onto the inside surface 50 of the cone shaped portion 60 of the vortex chamber 28. From here, the mixture of tar and liquid hydrocarbon 42' runs down the inside surface 50 to the bottom or sump 52 of the vortex chamber 28. A portion of the liquid hydrocarbon accumulation is recirculated via external pump 41. Spent liquid hydrocarbon and tar are pumped back to the gasifier 20 via the tar blow down pump 44, as previously described.

As illustrated by line J in FIGS. 1 and 2, the clean gas stream exits the vortex chamber 28 into the low-pressure surge tank 30. If the gasifier is operating a less than atmospheric pressure, an induced draft fan 62 conveys the gas from the vortex chamber 28 and into the surge tank 30. The surge tank is sized in residence time to provide gas mixing, compensating for fluctuations in the gasification process. The surge tank 30 also serves as a final knock out drum for final removal of liquids from the gas stream. Line K illustrates the clean gas stream flowing from the low-pressure surge tank 30.

Upon leaving the vortex chamber 28, the gas stream is sufficiently free of particulate matter and tar that it can be burned as fuel in an internal combustion device or can be utilized as synthetic gas for subsequent processing. Any residual particulate matter contained in the gas stream at this point is sub-micron in size. Tar passing through the vortex chamber 28 is not sufficient to cause any deterioration in extended operation of down-stream equipment. The temperature of the gas stream as it exits the surge tank 30 is approximately 110–150 degrees Fahrenheit.

The Invention of the Present Application

Figure 5:
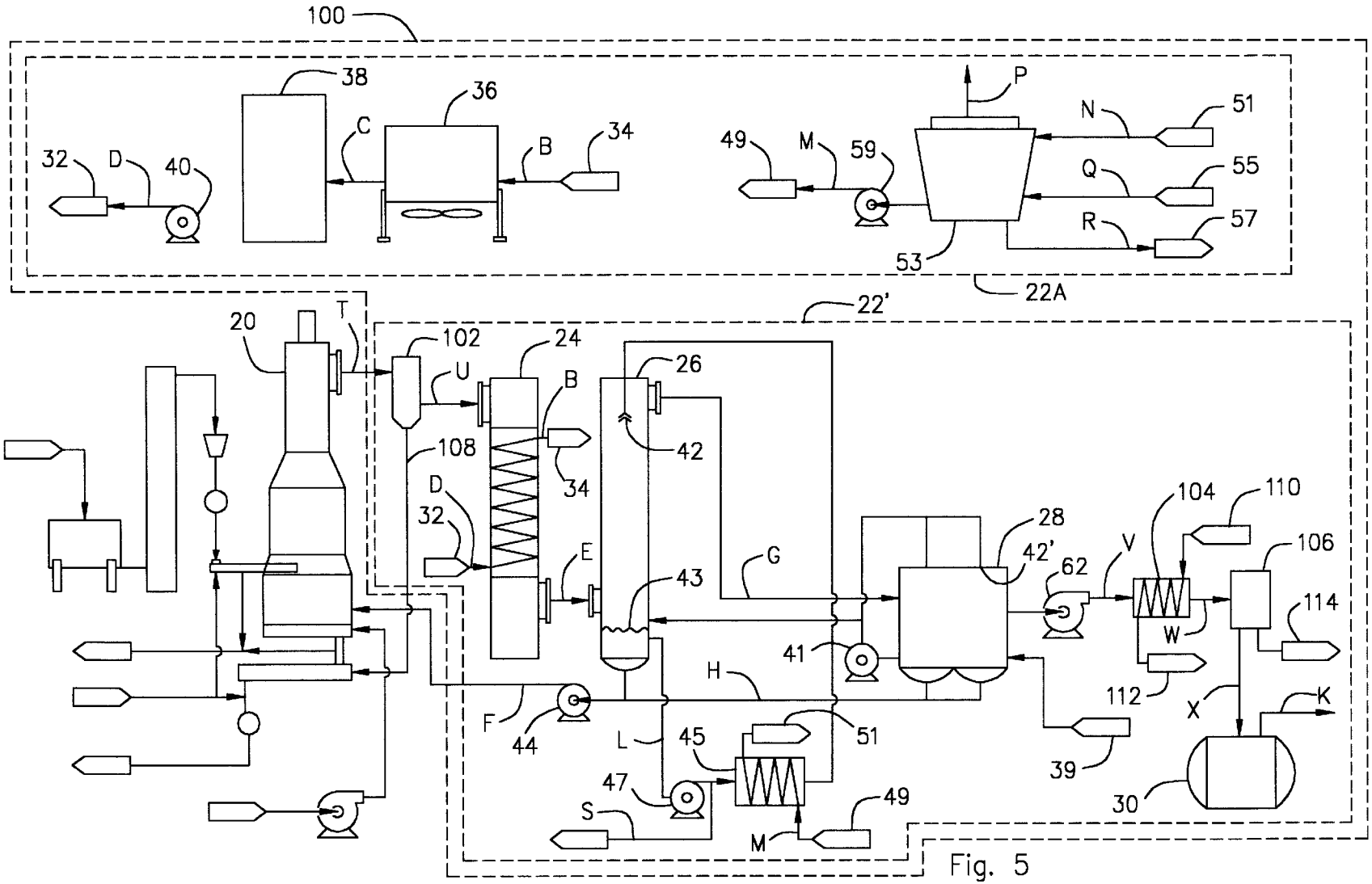
FIG. 5 is a flow diagram similar to FIG. 1 showing the improvement that is the subject of the present application. The flow diagram shows a gasifier employing equipment downstream of the gasifier that cleans the gas stream according to a preferred method of the present invention.
Figure 6:
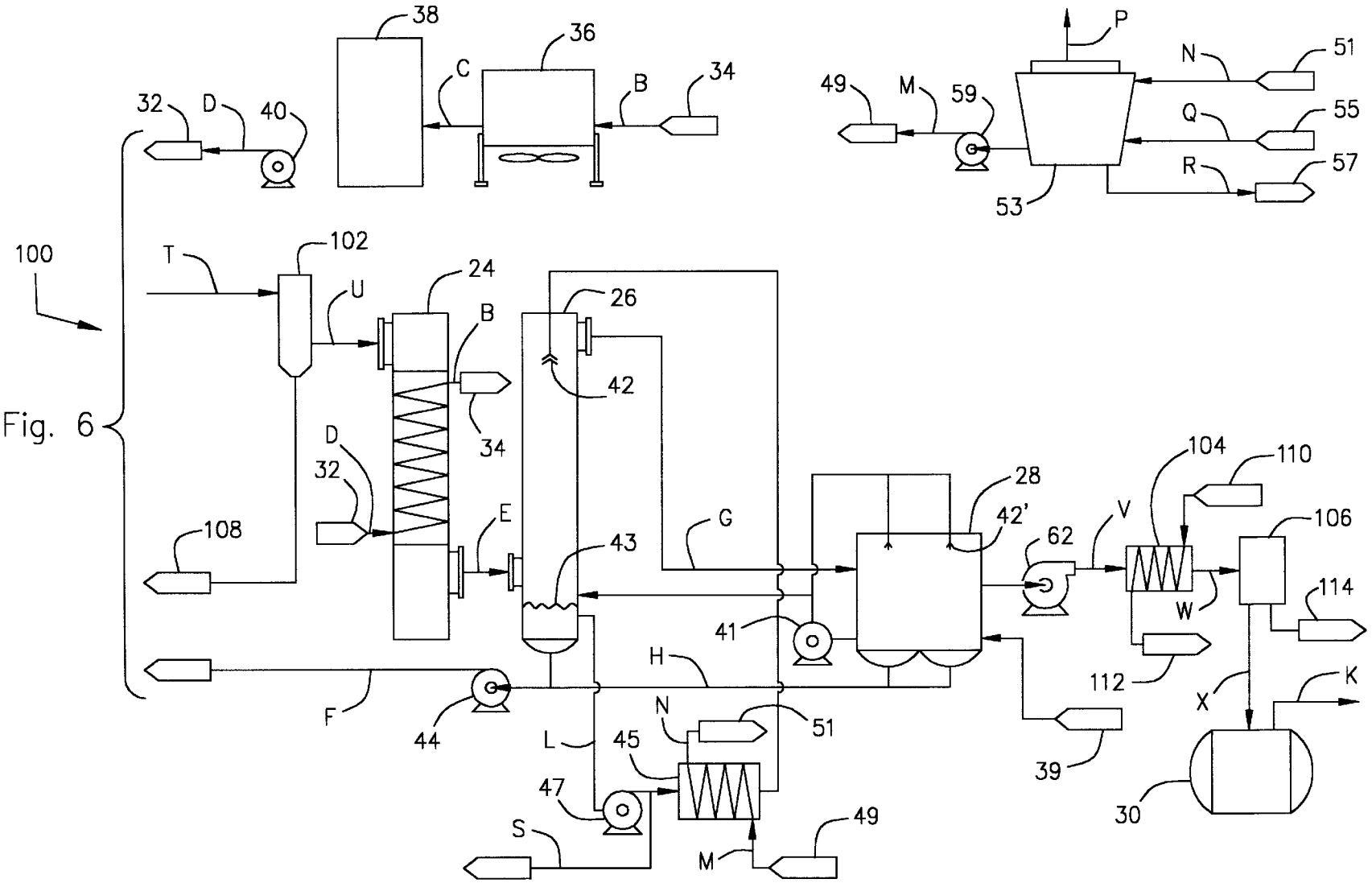
FIG. 6 is an enlarged portion of the diagram from FIG. 5, showing the equipment employed to clean the gas stream according to the present invention.

Referring now to FIGS. 5 and 6, a system 100 for removing particulate and aerosol from a gas stream according to a preferred embodiment of the present invention is illustrated. The system 100 is comprised of modified main process 22' and auxiliary process 22A. FIGS. 5 and 6 are the same as FIGS. 1 and 2, respectively, except that FIGS. 5 and 6 each include a high temperature cyclone separator 102 that has been inserted between the gasifier 20 and the indirect gas cooler 24, and FIGS. 5 and 6 each include a heat exchanger 104 followed by a demister 106 that have been inserted between the inducted draft fan 62 and the surge tank 30. The description of the process 22 and auxiliary process 22A provided above applies to the present system 100 except as specifically modified hereafter.

As shown in FIGS. 5 and 6, instead of previously described line A, line T indicates the gas stream flows from the gasifier 20 to the high temperature cyclone separator 102. Line U indicates the gas stream flows from the cyclone separator 102 to the indirect gas cooler 24.

The high temperature cyclone separator 102 is designed for hot operation and operates at temperatures exceeding approximately 1,000 degrees Fahrenheit, thus removing entrained fly ash without cooling the gas stream appreciably. The cyclone separator 102 is a conventional cyclone separator designed for high temperature operation. The cyclone separator 102 removes approximately 90% of the ash that is carried over in the gas stream from the gasifier 20. As shown by numeral 108, the ash is discharged along with the ash from the gasifier 20. Removal of this ash prevents fouling of the indirect gas cooler 24 immediately downstream of the cyclone separator 102, and allows the indirect gas cooler 24 to be made smaller and more efficient because there is less fouling. Specifically, the number of tubes provided in the indirect gas cooler 24 can be reduced and the diameter of those tubes can also be reduced. Removal of the ash also reduces the particulate loading on the direct contact spray scrubber 26 located downstream of the indirect gas cooler 24. This reduction in particulate loading on the direct contact spray scrubber 26 translates into less particles in the scrubbing oil, and therefore, less abrasion and a longer life for equipment, less blow down and impedes the deterioration of the scrubbing oil. Thus, the removal of the majority of the ash by the cyclone separator 102 allows the system 100 to be built less expensively, to operate less expensively, and to operate more reliably for longer periods of time without being brought down for cleaning.

Once the gas stream exits the cyclone separator 102, it is passes through the indirect gas cooler 24, as previously described above.

Also as shown in FIGS. 5 and 6, instead of previously described line J, line V indicates the gas stream flows from the induced draft fan 62 to the heat exchanger 104, line W indicates the gas stream flows from the heat exchanger 104 to the demister 106, and line X indicates the gas stream flows from the demister 106 to the low-pressure surge tank 30.

When the gas stream exits the vortex chambers 28, it passes through an induced draft fan 62. The induced draft fan 62 adds heat to the gas stream. This addition of heat is undesirable as it causes an increase in gas temperature and it causes an increase in gas volume. The increase in temperature results in an increase in vapor pressure and causes sub-micron particles that are present in the gas stream to revaporize and the particles are not removed in the surge tank 30. The increased volume of the gas results in less efficiency when the gas is ultimately burned.

To address these problems, the gas stream in the present invention passes from the induced draft fan 62 to the heat exchanger 104 that cools the gas to less than 120 degrees Fahrenheit, thus condensing additional impurities and water and reducing the gas volume. The heat exchanger 104 may employ water, as illustrated by numerals 110 and 112 provided by the cooling tower 53, or other suitable coolant as a cooling medium. The heat exchanger 104 removes the heat that has been added by the induced draft fan.

Upon exiting the heat exchanger 104, the gas stream finally passes through a demister 106 where the impurities and water that were condensed in the heat exchanger 104 are extracted from the gas stream. The demister 106 is of a type commercially available and provides sufficient internal surface area to remove suspended entrained condensate from the gas stream and also to condense additional impurities on the coalescing surface of the demister 106. The waste stream of condensate from the demister 106 is disposed, as illustrated by numeral 114.

Upon leaving the demister 106, the gas stream is sufficiently free of particulate matter and tar that it can be burned in an internal combustion device without fouling or can be subsequently processed. In fact, the concentration of residual oils, tar and particulate matter in the discharged synthesis gases will be 0.1 grains or less per dry standard cubic foot (approximately 250 milligrams or less per dry normal cubic meter or approximately 250 mg/dNm$^3$). Any residual particulate matter or hydrocarbon aerosols contained in the gas stream at this point are sub-micron in size and are not sufficient to cause any deterioration in extended operation of down-stream equipment.

Prior to introduction of the cleaned gas stream into down-stream equipment, the gas stream will enter the low-pressure surge tank 30, as illustrated by line X.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A method for removing particulate and aerosol contaminants from a gas stream originating from a negative or near atmospheric pressure gasifier consisting of the following steps:

a. separating ash from a gas stream that originated from a negative or near atmospheric pressure gasifier by passing the gas stream through a high temperature separator to remove ash that was carried over from the gasifier, b. cooling the gas stream to approximately 600 degrees Fahrenheit or below by passing it through an indirect gas cooler, c. liquid scrubbing the gas stream to remove particulate matter from the gas stream, to remove some of the aerosol tars contained in the gas stream, to condense some water vapor, to agglomerate water and particulate matter, and to further cool the gas stream to approximately 100 to 150 degrees Fahrenheit by directly contacting the gas stream with countercurrent flow of liquid hydrocarbon, d. mechanically scrubbing the gas stream to cause the remaining aerosol tars and agglomerated water and particulate matter to coalesce on the inside surface and thereby be removed from the gas stream by using a high speed fan to forcefully direct the gas stream against an inside surface of one or more vortex chambers before the gas stream passes through an induced draft fan, e. cooling the gas stream to condense remaining aerosol tars and water by passing it through a heat exchanger, and f. removing condensed aerosols from the gas stream by passing the gas stream through a demister.

2. A method for removing particulate and aerosol contaminants from a gas stream according to claim 1 wherein the high temperature separator of step a is a cyclone separator.

3. A method for removing particulate and aerosol contaminants from a gas stream according to claim 1 wherein the gas stream is cooled to less than 120 degrees Fahrenheit in step e.

4. A method for removing particulate and aerosol contaminants from a gas stream according to claim 3 wherein water is the cooling medium used in the heat exchanger of step e.

5. A method for removing particulate and aerosol contaminants from a gas stream according to claim 1 wherein 90% or more of the ash is removed from the gas stream in step a.

6. A method for removing particulate and aerosol contaminants from a gas stream originating from a pressurized gasifier consisting of the following steps:

a. passing a gas stream through a high temperature separator to remove ash that was carried over from the gasifier, b. passing the gas stream through a gas cooler to cool the gas stream to approximately 600 degrees Fahrenheit or below, c. passing the gas stream through a countercurrent direct contact spray scrubber to liquid scrub the gas stream with liquid hydrocarbon to remove particulate matter from the gas stream, to remove some of the aerosol tars contained in the gas stream, to condense some water vapor, to agglomerate water and particulate matter, and to further cool the gas stream, d. passing the gas stream through one or more vortex chambers that employ a high speed fan to forcefully direct the gas stream against an inside surface of each vortex chamber causing the remaining aerosol tars and agglomerated water and particulate matter to coalesce on the inside surface of each vortex chamber and be removed from the gas stream before the gas stream passes through an induced draft fan, e. passing the gas stream through a heat exchanger to cool it and condense remaining aerosol tars and water, and f. passing the gas stream through a demister to remove condensed aerosols from the gas stream.

7. A method for removing particulate and aerosol contaminants from a gas stream according to claim 6 wherein the high temperature separator of step a is a cyclone separator.

8. A method for removing particulate and aerosol contaminants from a gas stream according to claim 6 wherein the gas stream is cooled to less than 120 degrees Fahrenheit in step e.

9. A method for removing particulate and aerosol contaminants from a gas stream according to claim 6 wherein water is the cooling medium used in the heat exchanger of step e.

10. A method for removing particulate and aerosol contaminants from a gas stream according to claim 6 wherein 90% or more of the ash is removed from the gas stream in step a.

* * * * *